US006031925A

United States Patent [19]

Shteyn

[11] Patent Number: 6,031,925

[45] Date of Patent: Feb. 29, 2000

[54] TELESCOPING LOUDSPEAKER HAS MULTIPLE VOICE COILS

[75] Inventor: Yevgeniy Eugene Shteyn, Cupertino, Calif.

[73] Assignee: U.S. Philips Corporation, New York, N.Y.

[21] Appl. No.: 09/104,490

[22] Filed: Jun. 25, 1998

[51] Int. Cl.[7] ..... H04R 25/00

[52] U.S. Cl. ..... 381/401; 381/398; 381/403; 181/171

[58] Field of Search ..... 381/182, 186, 381/396, 398, 401, 403, 404, 405, 424, 432, FOR 152, FOR 154, FOR 155, FOR 159; 181/171, 172, 199

[56] References Cited

U.S. PATENT DOCUMENTS 5,323,469 6/1994 Scholtz ..... 381/432
5,604,815 2/1997 Paddock ..... 381/396
5,847,333 12/1998 D'Hoogh ..... 181/171

FOREIGN PATENT DOCUMENTS 403117300 5/1991 Japan .
WO 97/46046 12/1997 WIPO .

*Primary Examiner*—Huyen Le
*Attorney, Agent, or Firm*—Peter Verdonk

[57] ABSTRACT

A loudspeaker has a chassis, a cone, an actuator and a sub-frame. The actuator is coupled between the chassis and the diaphragm. The sub-frame is flexibly coupled to the chassis and the diaphragm. The diaphragm is flexibly suspended from the chassis. The actuator directly drives both the diaphragm and the sub-frame through coils attached to the cone and to the sub-frame.

7 Claims, 1 Drawing Sheet

TELESCOPING LOUDSPEAKER HAS MULTIPLE VOICE COILS

FIELD OF THE INVENTION

The invention relates to a device with a telescoping loudspeaker.

BACKGROUND ART

A telescoping loudspeaker is known from published European Patent Application (PHN 15,839), corresponding to U.S. patent application Ser. No. 08/859,590, herewith incorporated by reference. The telescoping loudspeaker combines large displacements of air combined with small size. The diaphragm, or, for short, cone, of the loudspeaker is flexibly suspended from a sub-frame, and the sub-frame is flexibly suspended from a chassis. One or more other sub-frames may be coupled between the chassis and the cone. The cone is moveable with regard to the sub-frame and the sub-frame is moveable with regard to the chassis. The cone is driven by an actuator. Thus, a large displacement volume can be obtained with a cone of relatively small diameter, owing to the accumulation of the individual amplitudes of one or more sub-frames and of the cone.

OBJECT OF THE INVENTION

The telescoping loudspeaker combines a high performance with small size. An analysis shows, however, that the mass of the sub-frame on the one hand and the mass of the combination of the cone, the suspension and voice coil on the other hand can have excursions of opposite phases, albeit over a limited frequency range. This may cause an undesired dip in the sound-pressure response. For example, in speaker with a 5.25" driver size, this resonance phenomenon may occur in the frequency range between approximately 80 Hz and approximately 130 Hz. The resonance can be minimized by carefully selecting appropriate values for the parameters involved, e.g., the ratio of the masses of the sub-frame and of the combination, and the ratio of the radiating surface area's associated with these masses.

An object of the invention is, among other things, to provide an alternative solution to the resonance problem.

SUMMARY OF THE INVENTION

To this end, the invention provides a device with a loudspeaker comprising a chassis, a diaphragm, an actuator assembly and a sub-frame. The actuator assembly is coupled between the diaphragm and the chassis. The sub-frame is flexibly coupled to the chassis and the diaphragm. The diaphragm is flexibly suspended from the chassis. The actuator assembly directly drives both the sub-frame and the diaphragm.

In the invention, both the diaphragm and the sub-frame are directly driven by the actuator assembly in the sense that there is a functionally inflexible connection between the driving actuator assembly and the driven subframe. Accordingly, the forces exerted on the diaphragm and on the sub-frame are in phase over a wider frequency. The excursions of both the sub-frame and the diaphragm remain therefore well controlled.

The actuator assembly of the loudspeaker referred to under the background art section drives the sub-frame only indirectly owing to the fact that the sub-frame is flexibly coupled to the diaphragm. The undesired resonance in this known loudspeaker is due to flexible coupling between the masses.

BRIEF DESCRIPTION OF THE DRAWINGS

The invention is explained by way of example and with reference to the accompanying drawing, wherein.

PREFERRED EMBODIMENTS

Figure 1:
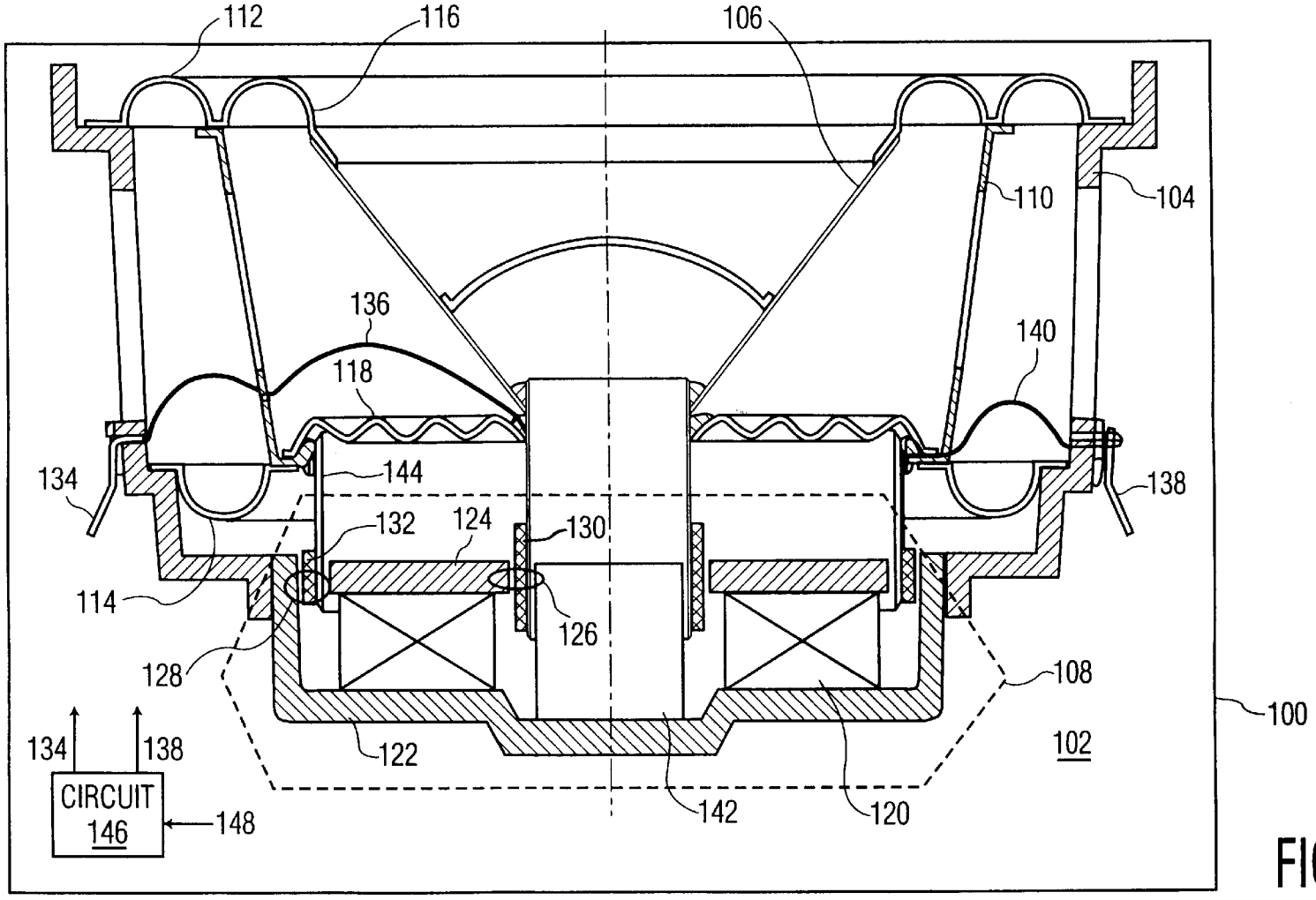
FIG. 1 is a diagram of a device with a loudspeaker according to the invention.

FIG. 1 is a diagram of a device 100 in the invention. Device 100 is, for example, a PC, a home theater, a car audio system, a portable CD player or radio, a speaker box, etc., with a loudspeaker 102, or just loudspeaker 102 with a mounting structure for physically attaching loudspeaker 102 to an environment. Loudspeaker 102 is shown in cross-section. Loudspeaker 102 has a chassis 104, a diaphragm 106, an actuator assembly 108, and a sub-frame 110. Actuator assembly 108 is coupled between chassis 104 and diaphragm 106. Sub-frame 110 is flexibly coupled to chassis 104, e.g., via flexible elements 112 and 114, and to diaphragm 106, e.g., via flexible elements 116 and 118. Accordingly, diaphragm 106 is flexibly suspended from chassis 104 through flexible elements 112–118. Actuator assembly 108 directly drives both diaphragm 106 and sub-frame 110.

In this example, actuator assembly 108 comprises a magnet system with a magnet 120 and with iron parts 122 and 124 that help concentrating the magnetic fields across an airgap 126 and an airgap 128. A first coil 130 is connected to diaphragm 106 and moves in airgap 126. A second coil 132 is connected to sub-frame 110. Coils 130 and 132 are coaxial in this example. Coils 130 and 132 conduct electric currents that are representative of the sound to be reproduced. The interaction of the currents with the magnetic fields in airgaps 126 and 128 causes diaphragm 106 and sub-frame 110 to move. A signal current is supplied to coil 130 via contact 134 and wire 136. A signal current is supplied to coil 132 via a contact 138 and a wire 140. To ensure functionally coaxial movement of diaphragm 106 and sub-frame 110, guiding parts 142 and 144 help to keep diaphragm 106 and sub-frame 110 aligned. Guiding part 144 directly couples the movement of coil 132 to sub-frame 110 as part 136 is a rigid extension of sub-frame 110.

Speaker 102 has two coils 130 and 132 as illustrated. In one embodiment, coils 130 and 132 receive similar signal currents that are synchronous. As mentioned above, the forces exerted on the diaphragm and on the sub-frame are in phase over a wider frequency than in the known art. In another embodiment, the signal currents are made to differ from each other so as to include a control signal that is combined with the signal supplied to at least one of coils 130 and 132. This provides a further control mechanism over the phase differences that may occur between diaphragm 106 and sub-frame 110. For example, in the latter embodiment, speaker 102 has an onboard electric circuit 146 that generates the appropriate control currents to be mixed with the sound current under control of the sound current itself, that is received from outside at a terminal 148. It is assumed that the control currents are determined by design parameters of device 102. For example, the axial length of coils 130 and 132, the density of their wire windings determine the responses of the coils to the magnetic field given the currents. Accordingly, circuit 146 is programmed by the manufacturer so as to represent the desired input current/output current characteristics. This approach helps to compensate electronically for any further remaining undesired resonance effect. Alternatively, the separate control of each current may help to add another dimension to the sound reproduced, by actively controlling the phase difference between the movement of diaphragm 106 and sub-frame 110, e.g., by increasing the phase difference at a certain frequency range or ranges.

I claim:

1. A device with a loudspeaker comprising:

a chassis;

a diaphragm;

an actuator assembly between the chassis and the diaphragm; and a sub-frame flexibly coupled to the chassis and the diaphragm;

wherein:

the diaphragm is flexibly suspended from the chassis; and the actuator assembly directly drives both the diaphragm and the sub-frame.

2. The device of claim 1, wherein:

the actuator assembly comprises first, second and third parts;

the first part is connected to the diaphragm;

the second part is connected to the sub-frame;

the third part is connected to the chassis; and the third part cooperates with the first and second part for driving the diaphragm and the sub-frame.

3. The device of claim 2, wherein the third part cooperates with the first and second part for driving the diaphragm and the sub-frame substantially in synchronism.

4. The device of claim 2, wherein the third part cooperates with the first and second part for driving the diaphragm and the sub-frame so as to control a phase difference between excursions of the diaphragm and the sub-frame.

5. The device of claim 4, comprising control means for generating at least one control signal for supply to at least one of the first, second and third part so as to control the phase difference.

6. The device of claim 2, wherein:

the first part comprises a first coil;

the second part comprises a second coil;

the third part comprises a magnet system for controlling a coaxial movement of the first and second coils.

7. The device of claim 6, comprising:

control means for generating at least one control signal;

the first coil and the second coil receive respective signals so as to limit a phase difference between excursions of the diaphragm and the sub-frame.

* * * * *